US008491013B2

(12) United States Patent
Peer et al.

(10) Patent No.: US 8,491,013 B2
(45) Date of Patent: Jul. 23, 2013

(54) CEMENTING SWIVEL AND RETAINER ARM ASSEMBLY AND METHOD

(75) Inventors: Richard D. Peer, Katy, TX (US); Robert J. Costo, Jr., The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 528 days.

(21) Appl. No.: 11/854,283

(22) Filed: Sep. 12, 2007

(65) Prior Publication Data

US 2008/0067810 A1 Mar. 20, 2008

Related U.S. Application Data

(60) Provisional application No. 60/845,010, filed on Sep. 15, 2006.

(51) Int. Cl.
*E21B 33/05* (2006.01)
*F16L 27/00* (2006.01)

(52) U.S. Cl.
USPC ..... 285/272; 166/291; 403/154

(58) Field of Classification Search
USPC ..... 166/291, 75.15, 70, 177.4, 285; 285/272; 403/154; 175/162
See application file for complete search history.

(56) References Cited

U.S. PATENT DOCUMENTS

| | | | | |
|---|---|---|---|---|
| 1,904,765 | A * | 4/1933 | Hawk | 173/6 |
| 4,736,807 | A * | 4/1988 | Davis | 173/164 |
| 6,904,970 | B2 | 6/2005 | Simson | |
| 7,066,249 | B2 | 6/2006 | Simson | |
| 2008/0041578 | A1 * | 2/2008 | Robichaux et al. | 166/78.1 |

OTHER PUBLICATIONS

Search Report from UK IPO dated Dec. 14, 2007 (5 pages).

* cited by examiner

*Primary Examiner* — Kenneth L Thompson
*Assistant Examiner* — James Sayre
(74) *Attorney, Agent, or Firm* — Brandon S. Clark

(57) ABSTRACT

A cementing swivel includes an outer stationary member having a cement port, an inner rotating member with a bore therethrough, and a torque indicating member coupled to the outer stationary member and configured to provide a visual indication that a predetermined torque load has been reached.

8 Claims, 6 Drawing Sheets

CEMENTING SWIVEL AND RETAINER ARM ASSEMBLY AND METHOD

CROSS-REFERENCE TO RELATED APPLICATIONS

This application claims benefit, under 35 U.S.C. §119, of U.S. Provisional Application Ser. No. 60/845,010 filed on Sep. 15, 2006 and entitled "Cement Swivel and Retainer Arm Assembly and Method" in the name of Richard Peer and Robert Costo, Jr., and incorporated herein by reference in its entirety.

BACKGROUND

1. Field of the Disclosure

The present disclosure relates generally to apparatuses and methods for cementing downhole tubulars into a well bore, and more particularly, the present disclosure relates to a cementing manifold swivel.

2. Background Art

A well-known method of drilling hydrocarbon wells involves disposing a drill bit at the end of a drill string and rotating the drill string from the surface utilizing either a top drive unit or a rotary table set in the drilling rig floor. As drilling continues, progressively smaller diameter tubulars comprising casing and/or liner strings may be installed end-to-end to line the borehole wall. Thus, as the well is drilled deeper, each string is run through and secured to the lower end of the previous string to line the borehole wall. Then the string is cemented into place by flowing cement down the flowbore of the string and up the annulus formed by the string and the borehole wall.

To conduct the cementing operation, typically a cementing manifold is disposed between the top drive unit or rotary table and the drill string. Thus, due to its position in the drilling assembly, the cementing manifold must suspend the weight of the drill pipe, contain pressure, transmit torque, and allow unimpeded rotation of the drill string. When utilizing a top drive unit, a separate inlet is preferably provided at a swivel to connect the cement lines.

In operation, the cementing manifold and swivel allow fluids, such as drilling mud or cement, to flow therethrough while simultaneously enclosing and protecting from flow, a series of darts and/or spheres that are released on demand and in sequence to perform various operations downhole. Thus, as fluid flows through the cementing manifold, the darts and/or spheres are isolated from the fluid flow until they are ready for release.

Cementing manifolds and swivel assemblies are available in a variety of configurations; with the most common configuration comprising a sphere/single dart manifold. The sphere is dropped at a predetermined time during drilling to form a temporary seal or closure of the flowbore of the drill string, for example, or to actuate a downhole tool, such as a liner hanger, in advance of the cementing operation, for example. Once the cement has been pumped downhole, the dart is dropped to perform another operation, such as wiping cement from the inner wall of a string of downhole tubular members. One such manifold and swivel is described in U.S. Pat. No. 6,904,970 to Simson and U.S. Pat. No. 7,066,249 to Simson, both hereby incorporated herein by reference in their entireties.

In operation, the outer housing of the swivel is designed to remain stationary, while an inner mandrel rotates within the housing to enable a top drive unit to rotate the drill string. However, during liner running and cementing operations, conditions can occur wherein excessive amounts of torque are applied to the swivel assembly. It is important that the outer housing remain stationary and that excessive amounts of torque are not applied to the swivel so that cementing lines or other equipment does not fail. If such a failure were to occur, rig personnel would be exposed to high pressure, and high velocity fluids, which could result in personal injury or environmental damage.

SUMMARY OF THE DISCLOSURE

In one aspect, the present disclosure relates to a cementing swivel that includes an outer stationary member having a cement port, an inner rotating member with a bore therethrough, and a torque indicating member coupled to the outer stationary member and configured to provide a visual indication that a predetermined torque load has been reached.

In another aspect, the present disclosure relates to a retainer arm assembly that includes a pin plate having a first hole and a second hole, a retainer pin, a shear pin, and a slide arm having a retainer pin slot and a shear pin hole. The retainer arm assembly is configured to attach to an outer stationary member of a cementing swivel. The slide arm is configured to shear the shear pin in response to a predetermined torque applied to the outer stationary member of the cementing swivel.

In another aspect, the present disclosure relates to a method of cementing a well using a cementing swivel comprising an outer stationary member, which comprises a cement port, and an inner rotating member connected to a drill string. The method includes determining a maximum torque to be applied to the cementing swivel, setting a torque indicating member according to the determined maximum torque, rotating the drill string, and stopping the rotating after the torque indicating member provides a visual indication that the determined maximum torque has been reached.

Other aspects and advantages of the disclosure will be apparent from the following description and the appended claims. The various characteristics described above, as well as other features, will be readily apparent to those skilled in the art upon reading the following detailed description, and by referring to the accompanying drawings.

DETAILED DESCRIPTION

Figure 1:
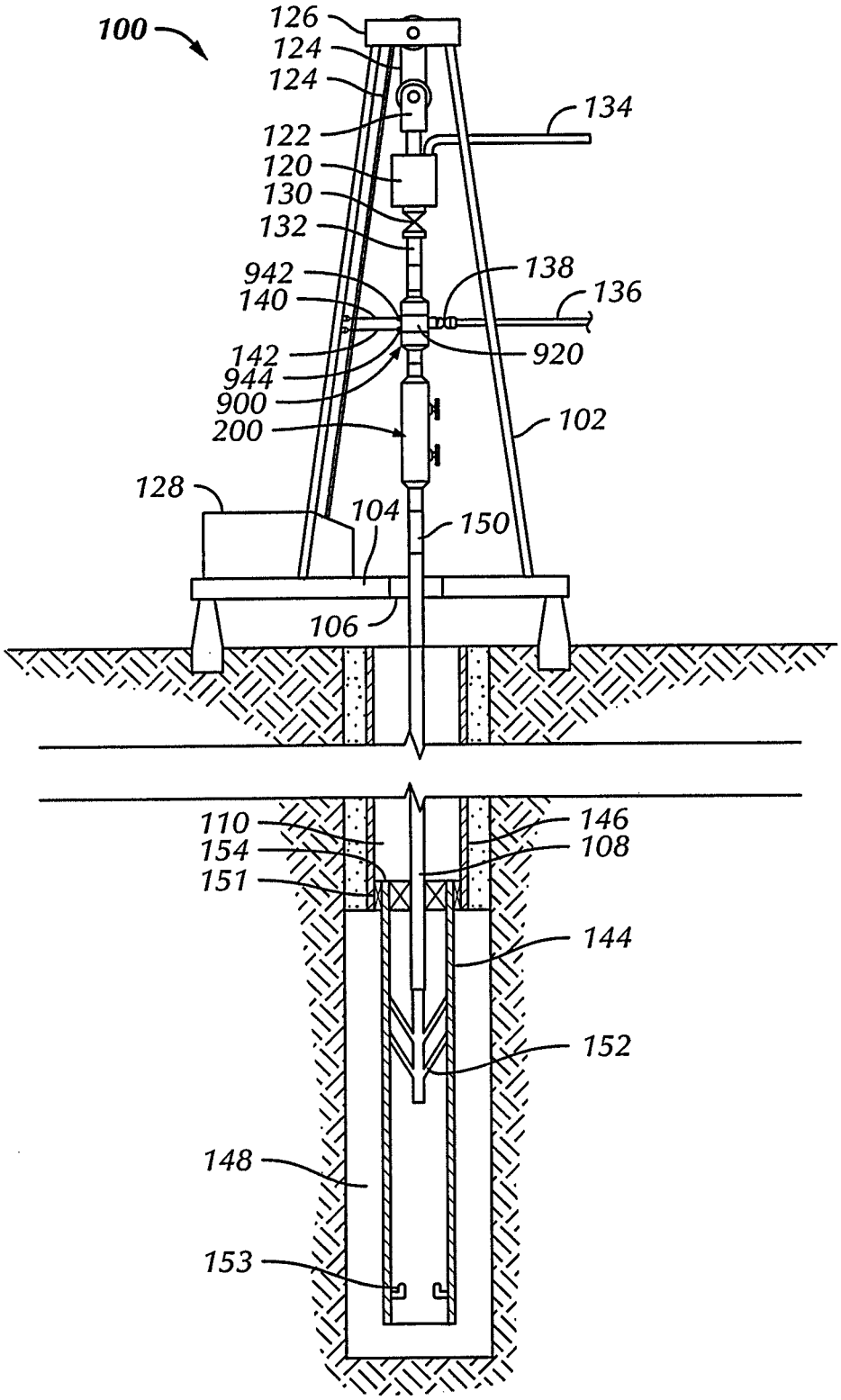
FIG. 1 schematically depicts a drilling system in which one or more embodiments of the disclosure may be utilized.

Embodiments of the disclosure are shown in the above-identified figures and described in detail below. In describing the following embodiments, like or identical reference numerals are used to identify common or similar elements.

FIG. 1 schematically depicts a drilling system in which embodiments of the present disclosure may be utilized. However, one of ordinary skill in the art will understand that the embodiments disclosed herein are not limited to use with a particular type of drilling system. The drilling rig 100 includes a derrick 102 with a rig floor 104 at its lower end having an opening 106 through which drill string 108 extends downwardly into a well bore 110. The drill string 108 is driven rotatably by a top drive drilling unit 120 that is suspended from the derrick 102 by a traveling block 122. The traveling block 122 is supported and moveable upwardly and downwardly by a cabling 124 connected at its upper end to a crown block 126 and actuated by conventional powered draw works 128. Connected below the top drive unit 120 are a kelly valve 130, a pup joint 132, a cementing swivel 900, and a cementing manifold. A flag sub 150, which provides a visual indication when a dart or sphere passes there through, is connected below the cementing manifold 200 and above the drill string 108. A drilling fluid line 134 routes drilling fluid to the top drive unit 120, and a cement line 136 routes cement through a valve 138 to the swivel 900.

Figure 2:
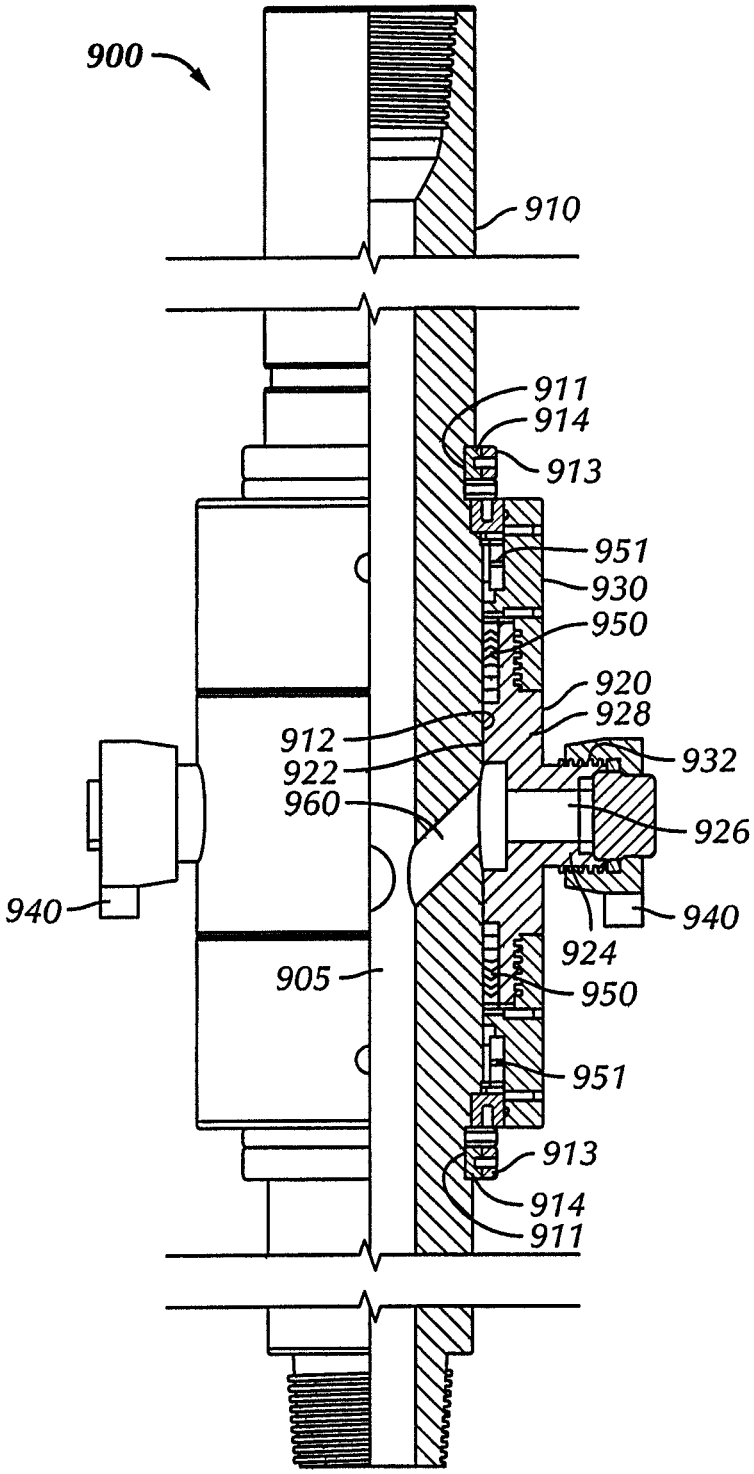
FIG. 2 is a side view, partially in cross-section, of a cementing swivel in which one or more embodiments of the disclosure may be utilized.
Figure 7:
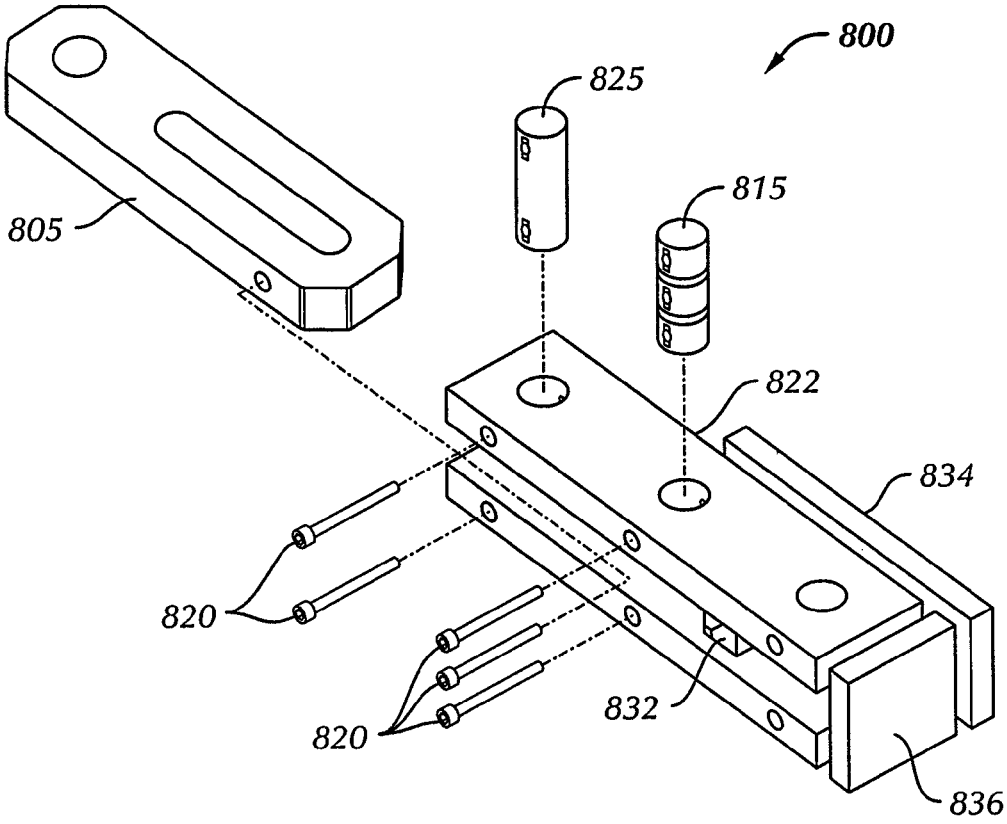
FIG. 7 is a perspective exploded view of a retainer arm assembly in accordance with an embodiment of the disclosure.

Any cementing swivel may be utilized. In one embodiment, the cementing swivel 900 is configured as shown in FIG. 2. Referring now to FIGS. 1 and 2, the swivel 900 includes a mandrel 910, a housing 920, and a cap 930, with upper and lower seal assemblies 950 disposed above and below a cement port 960 and between the mandrel 910 and the housing 920. The swivel 900 may provide cement line connections 940 and tie-off connections 942, 944 (shown in FIG. 1). A retainer arm assembly 800 (shown in FIG. 7) may be connected to at least one of the connections 942, 944. Mandrel 910 includes upper and lower threaded connections for connecting the upper end of mandrel 910 to top drive unit 120 and the lower end to the cementing manifold 200 connected to the upper end of drill string 108.

The housing 920 includes one or more radially projecting integral conduits 924 with a cement port 926 extending through conduit 924 and the wall 928 of housing 920. Housing 920 and conduits 924 are preferably made from a common tubular member such that conduits 924 are integral with housing 920 and do not require any type of fastener including welding. Conduit 924 provides a connection means, such as threads 932, for connecting cement line 136 to swivel 900.

The preferred swivel 900 also includes two swivel connections 940 for redundancy in case one connection 940 becomes damaged. The cement ports 960 within the mandrel 910 are preferably angled so that as cement flows through the connection 940, it enters the throughbore 905 of the mandrel 910 generally in the downwardly direction. This allows the cement to impinge on the wall of throughbore 905 at an angle and minimizes erosion of the ports 960 and mandrel 910.

An additional feature of the preferred swivel 900 is that the mandrel 910 includes a common cylindrical outer surface 912 in the areas of the bearings 951 and seal assemblies 950, which are disposed in recessed areas in the housing 920. Conventional mandrels included a step shoulder on the mandrel for the seals, requiring individual seal placement. The common cylindrical outer surface 912 of the mandrel 910 allows for the bearings 951 and seal assemblies 950 to be positioned within the housing 920 as one unit, such that the mandrel 910 can then slide through the bore 922 of the housing 920 and assembled cap 930. A groove 911 is provided at each end of the mandrel 910, and an externally threaded, split cylindrical ring 914 is positioned within the grooves 911. An internally threaded ring 913 is screwed onto the split ring 914, and these rings 913, 914 hold the assembled housing 920 and cap 930 in place on the mandrel 910.

Referring again to FIG. 1, in operation, drilling fluid flows through line 134 down into the drill string 108 while the top drive unit 120 rotates the drill string 108. The housing 920 of cementing swivel 900 is tied-off to the derrick 102 via lines or bars 140, 142 such that the swivel housing 920 cannot rotate and remains stationary while the mandrel 910 of the swivel 900 rotates within housing 920 to enable the top drive unit 120 to rotate the drill string 108.

To perform an operation such as, for example, actuating a downhole tool to suspend a tubular 144, such as a casing string or liner, from existing and previously cemented casing 146, a sphere may be dropped from the cementing manifold 200. Then, once the tubular 144 is suspended from the casing 146 via a rotatable liner hanger 151, cement will be pumped down through the drill string 108 and through the tubular 144 to fill the annular area 148 in the uncased well bore 110 around the tubular 144. A liner 154 may be provided between the drill string 108 and the tubular 144 to provide a seal therebetween. To start the cementing operation, the kelly valve 130 is closed, and the valve 138 to the cement line 136 is opened, thereby allowing cement to flow through the swivel 900 and down into the drill string 108. Thus, the swivel 900 enables cement flow to the drill string 108 while bypassing the top drive unit 120.

During cementing, the drill string 108 may be rotated to ensure that cement is distributed evenly around the tubular 144 downhole. More specifically, because the cement is a thick slurry, it tends to follow the path of least resistance. Therefore, if the tubular 144 is not centered in the well bore 110, the annular area 148 will not be symmetrical, and cement may not completely surround the tubular 144. Thus, it is preferable for the top drive unit 120 to continue rotating the drill string 108 through the swivel 900 while cement is introduced from the cement line 136. When the appropriate volume of cement has been pumped into the drill string 108, a dart is typically dropped from the cementing manifold 200 to latch into a larger dart 152 to wipe cement from the tubular 144 and land in the landing collar 153 adjacent the bottom end of the tubular 144.

Figure 3:
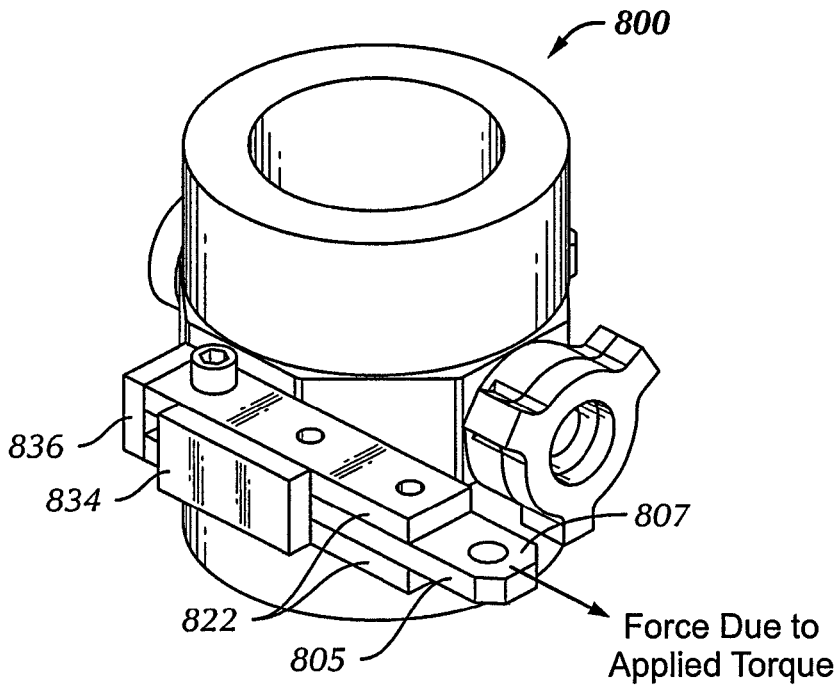
FIG. 3 is a perspective view of the cementing swivel and retainer arm assembly in a normal operating position in accordance with an embodiment of the disclosure.
Figure 4:
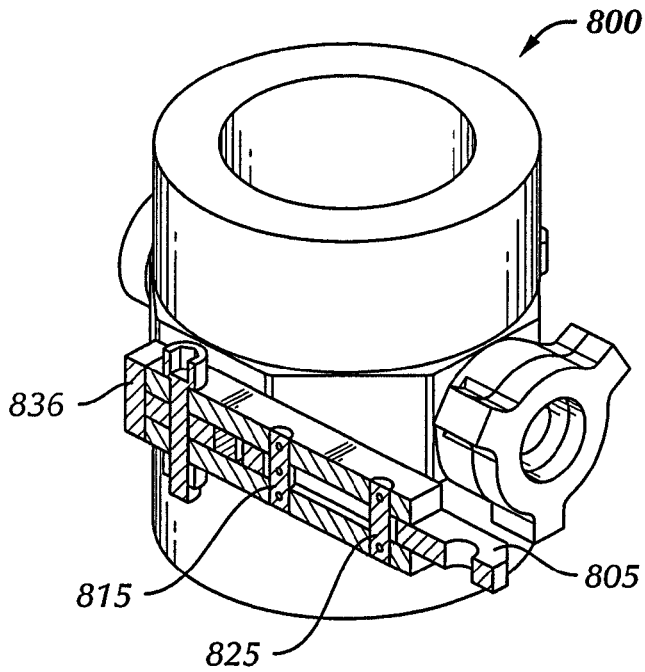
FIG. 4 is a partial cutaway view of the cementing swivel and retainer arm assembly shown in FIG. 3.
Figure 8:
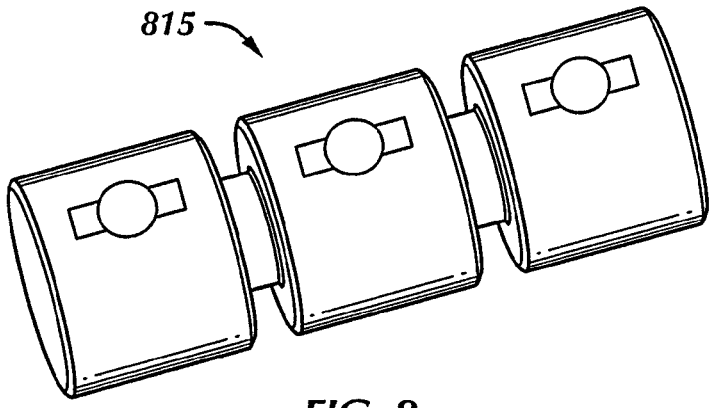
FIG. 8 is a perspective view of a shear pin in accordance with an embodiment of the disclosure.
Figure 9:
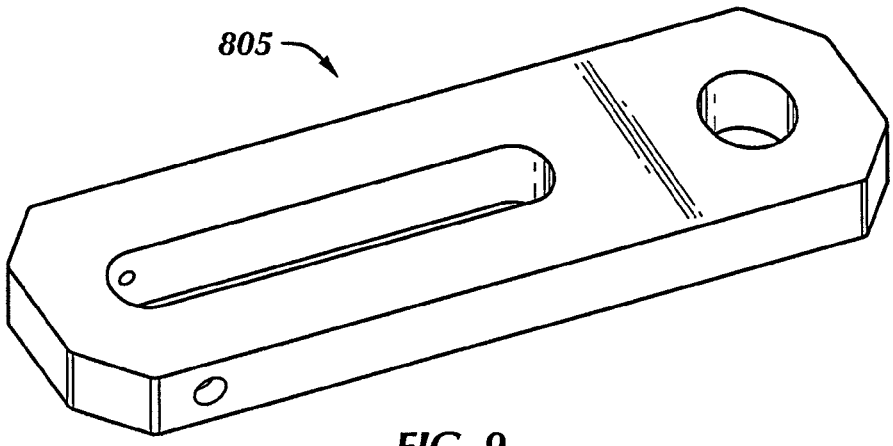
FIG. 9 is a perspective view of a slide arm in accordance with an embodiment of the disclosure.

FIGS. 3 and 4 show the retainer arm assembly 800 wherein the slide arm 805 is in a normal operation mode in which a shear pin 815 (shown in FIG. 8) has not sheared. In a preferred embodiment, the retainer arm assembly 800 is bolted to the swivel housing 920 at at least one of the connections 942, 944. The connection of the assembly is further reinforced by center wall 832, back wall 834, and end wall 836. The direction of force applied, as indicated in FIG. 3 is representative and may not represent the actual direction of loading. An end 807 of the slide arm 805 (shown in FIG. 9) is shackled or otherwise tied-off to the derrick 102 via lines or bars 140, 142 such that the swivel housing 920 cannot rotate and remains stationary while the mandrel 910 of the swivel 900 rotates within housing 920 to enable the top drive unit 120 to rotate the drill string 108.

Figure 5:
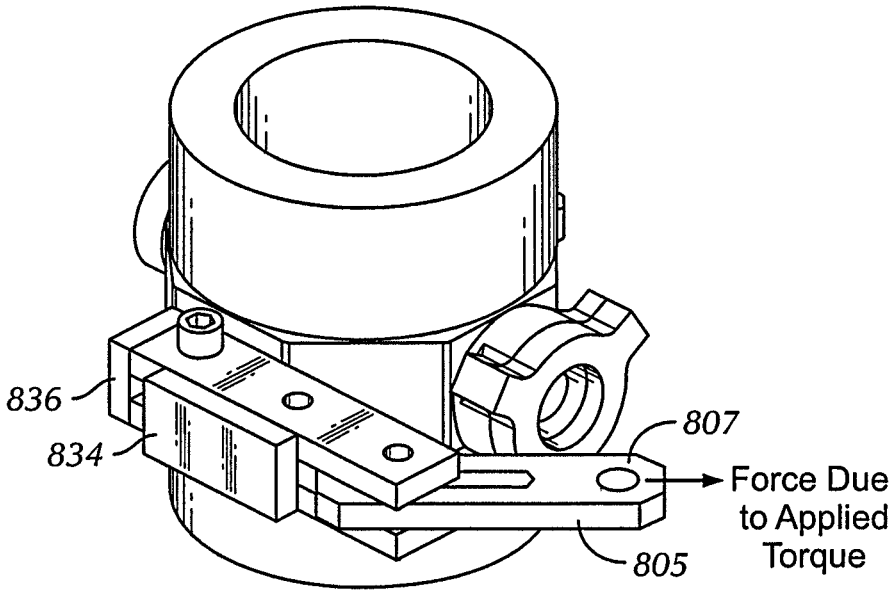
FIG. 5 is a perspective view of the cementing swivel and retainer arm assembly of FIG. 3 in a "break over" position.
Figure 6:
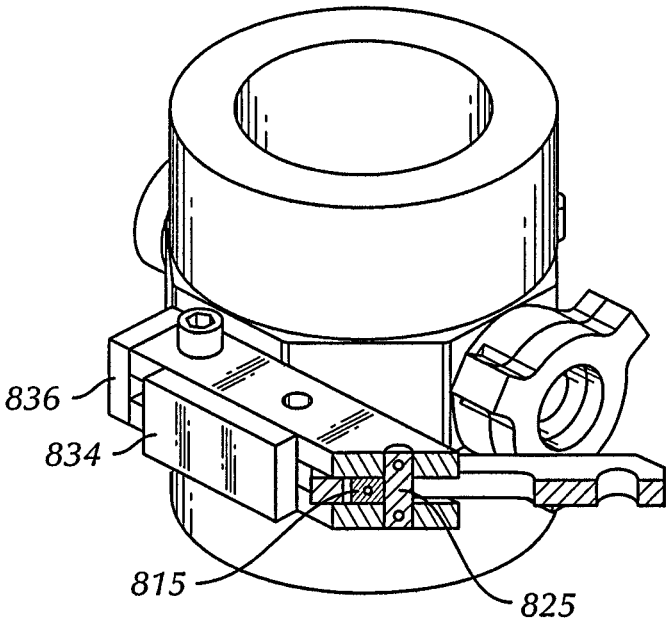
FIG. 6 is a partial cutaway view of the cementing swivel and retainer arm assembly of FIG. 3 in a "break over" position.

FIGS. 5 and 6 show the retainer arm assembly 800 positioned wherein a predetermined torque limit was exceeded.

Figure 10:
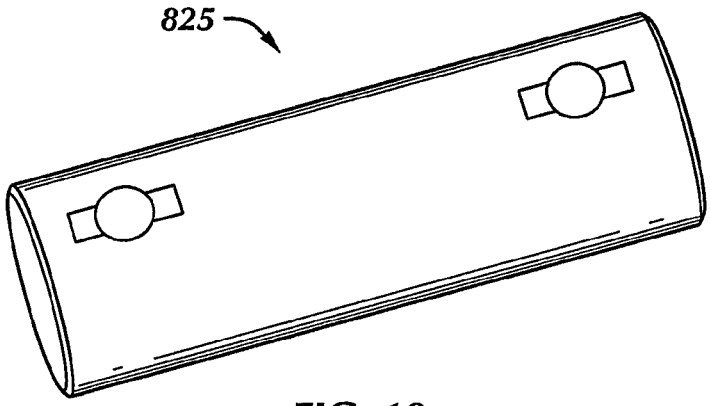
FIG. 10 is a perspective view of a retainer pin in accordance with an embodiment of the disclosure.
Figure 11:
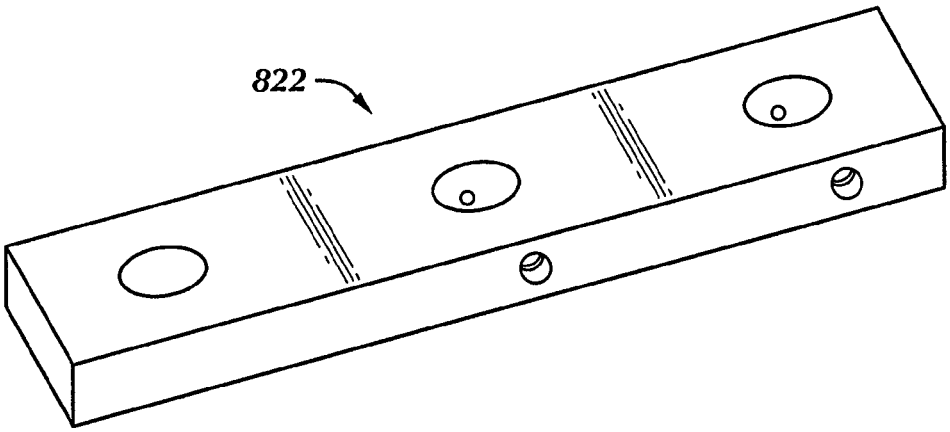
FIG. 11 is a perspective view of a pin plate in accordance with an embodiment of the disclosure.

Prior to assembly and operation of the swivel and retainer arm assembly 800, the maximum amount of torque to be applied to the swivel 900 is determined and a shear pin 815 designed to break at the corresponding load is selected for use in the assembly 800. When the shear limit of the shear pin 815 is reached, the pin 815 will break and the slide arm 805 will travel "break-over" as shown in FIGS. 5 and 6. When the "break over" occurs, the pin 815 has sheared and the slide arm 805 travels laterally between pin plates 822 (shown in FIG. 11) and then pivots about the retainer pin 825. The arm 805 is retained in the assembly 800 by the retainer pin 825 (shown in FIG. 10). The center section of the shear pin 815 and retainer pin 825 are retained in the assembly 800 by retainer or retention bolts 820, best shown in FIGS. 6 and 7. Thus, the shear pin piece, once broken, are held within the assembly by retention bolts, thereby eliminate a falling object hazard in the event of a "break over."

When this "break-over" action occurs, the rig operator will be provided with a visual indicator that the torque limit has been reached, thereby enabling the operator to take remedial action before damage to the rig, hoses 134 or 136, or other rig component occurs. In a preferred embodiment, the assembly is designed so as to a allow the slide are 805 to rotate through a limited angle which would keep the hoses 134, 136 from wrapping around the cementing manifold or drill string and tearing. In a preferred embodiment, the limited angle is about 135 degrees.

In addition to the visual indication of the "break over," an audible indication, the sound of shearing or breakage of the shear pin 815 and the travel of the slide arm 805, will also alert the rig operator that the predetermined torque limit has been reached.

After remedial action is taken, the shear pin 815 and retaining pin 825 may be replaced in the field with no requirements for special tooling, thus the retainer arm assembly 800 can be readily redressed in the field.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

What is claimed is:

1. A cementing swivel comprising:

an outer stationary member comprising a cement port;

an inner rotating member with a bore therethrough; and a retainer arm assembly coupled to the outer stationary member, the retainer arm assembly comprising:

a slide arm having a pin slot therein configured to engage a retainer pin; and a shear pin configured to prevent lateral movement of the slide arm against a torque acting on the slide arm up to a predetermined shear limit of the shear pin and to provide one of a visual and an audible remedial indicator of the torque exceeding the limit before torque induced damage to a rig component.

2. The swivel of claim 1, wherein the retainer arm assembly is configured to retain at least a portion of the shear pin after shearing of the shear pin.

3. The swivel of claim 1, wherein the retainer arm assembly further comprises a retention bolt configured to retain at least a portion of the shear pin after shearing of the shear pin.

4. A retainer arm assembly comprising:

a pin plate comprising a first hole and a second hole;

a retainer pin;

a shear pin; and a slide arm comprising a retainer pin slot and a shear pin hole, wherein the retainer arm assembly is configured to attach to an outer stationary member of a cementing swivel, wherein the slide arm is configured to shear the shear pin, slide laterally relative to the pin plate, and pivot about the retainer pin to provide one of a visual and an audible indicator of a predetermined torque applied to the outer stationary member of the cementing swivel before torque induced damage to a rig component ensues.

5. The retainer arm assembly of claim 4 further configured to retain at least a portion of the shear pin after shearing of the shear pin.

6. A method of cementing a well using a cementing swivel disposed at a rig adjacent the well and comprising an outer stationary member comprising a cement port and an inner rotating member connected to a drillstring, the method comprising:

coupling a retainer arm to the outer stationary member, the retainer arm assembly comprising a slide arm secured by a shear pin, wherein the slide arm is attached to a fixed location on the derrick;

rotating the drillstring and the inner rotating member;

shearing the shear pin, sliding the slide arm laterally, and pivoting the slide arm about a retainer pin when a predetermined torque limit acting on the slide arm is reached;

providing one of a visual and an audible indication to an operator that the predetermined torque limit has been reached; and undertaking remedial action in advance of torque induced damage to a component of the rig.

7. The method of claim 6 further comprising retaining at least a portion of the shear pin after said shearing thereof.

8. The method of claim 7 wherein said retaining is achieved with a retention bolt of the retainer arm assembly.

* * * * *